United States Patent [19]
Libutti et al.
[11] 4,134,728
[45] Jan. 16, 1979

[54] N-AMINOETHYL ETHANOLAMINE AS A COLD-END ADDITIVE

[75] Inventors: Bruce L. Libutti, Bethayres; Francis J. Oschell, North Hills, both of Pa.

[73] Assignee: Betz Laboratories, Inc., Trevose, Pa.

[21] Appl. No.: 833,797

[22] Filed: Sep. 16, 1977

Related U.S. Application Data

[63] Continuation of Ser. No. 713,727, Aug. 12, 1976, abandoned.

[51] Int. Cl.[2] ..... C23F 11/00; C23F 11/02
[52] U.S. Cl. ..... 422/9; 110/343; 110/345; 252/392; 423/242; 423/243; 423/244
[58] Field of Search ..... 21/2.5 B; 423/243, 244, 423/242; 110/1 J, 1 K, 343, 345; 252/389 R, 392

[56] References Cited

U.S. PATENT DOCUMENTS

| | | | |
|---|---|---|---|
| 2,106,446 | 1/1938 | Baehr et al. | 423/243 X |
| 2,155,853 | 4/1939 | Anthony | 423/243 X |
| 2,972,861 | 2/1961 | Davies | 21/2.5 B UX |
| 3,709,977 | 1/1973 | Villiers-Fisher | 423/244 |
| 3,856,921 | 12/1974 | Shrier et al. | 423/243 X |
| 3,873,673 | 3/1975 | Teague et al. | 423/243 |
| 3,886,261 | 5/1975 | Libutti | 423/244 |
| 3,904,735 | 9/1975 | Atwood et al. | 423/243 |
| 3,932,588 | 1/1976 | Libutti et al. | 423/244 |
| 3,961,018 | 6/1976 | Williamson | 423/243 X |
| 3,962,404 | 6/1976 | Grammarco et al. | 423/243 X |

FOREIGN PATENT DOCUMENTS

| | | | |
|---|---|---|---|
| 872984 | 7/1961 | United Kingdom | 423/244 |

*Primary Examiner*—Barry S. Richman
*Attorney, Agent, or Firm*—Alexander D. Ricci; Steven H. Markowitz

[57] ABSTRACT

A method of reducing the amount of sulfur trioxide condensation on, and therefore the amount of sulfuric acid corrosion of, metal parts at the cold-end of a combustion system and in contact with combustion gases derived from the combustion of sulfur containing fuel, said method comprising adding to the combustion gases an effective amount for the purpose of an alkanolamine additive particularly N-aminoethyl ethanolamine.

16 Claims, No Drawings

N-AMINOETHYL ETHANOLAMINE AS A COLD-END ADDITIVE

This is a continuation of application Ser. No. 713,727 filed Aug. 12, 1976 now abandoned.

DISCLOSURE OF THE INVENTION

As is well known to boiler operators, sulfur-containing fuels present problems not only from a pollutional point of view, i.e., acid smut, but also with respect to the life and operability of metallic equipment and parts which are in contact with the flue gases containing the sulfur by-products of combustion.

Upon combustion, the sulfur in the fuel is converted to sulphur dioxide and sulfur trioxide. When sulfur trioxide reaches its dew temperature, it reacts with moisture in the flue gas to produce the very corrosive sulfuric acid. The gases themselves are troublesome as air pollutants, while the acid formed is damaging from corrosion aspects.

As can be appreciated, the greater the sulfur content of the fuel, the more the effects are harmful. This is particularly the case in industrial and utility operations where low grade oils are used for combustion purposes.

Although many additives have been utilized for the purpose of conditioning flue gases, few additives have found overall success. The reason for the relatively little success in this area is felt to be the peculiarities found in the different combustion systems and boiler designs. The gas dynamics and the loads produced sometimes make chemical treatments for the most part impractical, therefore, requiring a combination of mechanical and chemical treatment.

The basic area to which the present invention is directed is often referred to in the industry as the "cold-end" of a boiler operation. This area is generalized as being the path in the boiler system that the combustion gases follow after the gases have, in fact, performed their service of heating water, producing steam and/or superheating steam.

In the larger boiler systems, the last stages through which the hot combustion gases flow include the economizer, the air heater, the collection equipment or the electrostatic precipitator, and then the stack through which the gases are discharged.

In three articles, a first entitled "The Selection and Use of Additives in Oil-fired Boilers," by W. D. Jarvis and appearing in the November, 1958 issue of the *Journal of the Institute of Fuel;* a second entitled "The Use of Ammonia for Reducing Air-heater Corrosion at Bankside Generating Station, C.E.G.B.," by J. T. S. Gundry, B. Lees, L. K. Rendle, and E. J. Wicks and appearing in the October, 1964 issue of *Combustion;* and a third entitled "The Use of Heterocyclic Tertiary Amines for the Control of Corrosion Caused by Flue Gases," by E. Brett Davies and B. J. Alexander and appearing in the April, 1960 issue of the *Journal of the Institute of Fuel;* the use of heterocyclic tertiary amines, obtained from the distillation of crude coal tar, as boiler cold-end additives is disclosed. Besides disclosing that heterocyclic tertiary amines inhibit boiler cold-end corrosion, the articles also point out that the use of these chemicals causes black carbonaceous deposits on cold-end surfaces, which deposits can become pasty and have a pronounced smell, apparently due to their derivation from coal tar.

The present invention is drawn to the present inventor's discovery of alkanolamines as cold-end additives.

It was determined that if an alkanolamine (or mixture of alkanolamines) is fed, preferably in droplet form to the moving combustion gases upstream of the cold-end surfaces to be treated and at a point where the gases are undergoing turbulence, the chemical will travel along with the gases as vapor and/or liquid droplets and deposit on the downstream cold-end surfaces. The deposition of the alkanolamine on the cold-end surfaces results from the transition of the gas flow from a zone of relative turbulence to a zone where the turbulence subsides and/or from the lowering of the temperature of combustion gases below the dew point of the chemical. In addition, droplets will impact on the surfaces. It is understood that any reference to an alkanolamine is intended to include mixtures of such compounds.

The liquid additive can be fed as an aqueous solution, and, as noted above, to ensure effective results, the additive is preferably fed in droplet form to the gases and in a zone of turbulence upstream of the surfaces to be treated. There are numerous methods available to the artisan for feeding the additive in droplet form, which methods are deemed well within the skill of the art. For example, liquid atomizer nozzles could be utilized for the purpose. The present inventors obtained satisfactory results using a sonic feed nozzle to produce a mist of the additive solution even though additive deposits formed on the nozzle. The use of a pressure atomizing nozzle system with in-line dilution and water purging should resolve any problems related to the formation of deposits on the nozzle. The size range of the liquid droplets is preferably small enough to ensure that the additive which does not evaporate but, instead, is present in the combustion gases in liquid droplet form, will be carried along with the combustion gases so as to be deposited on the surfaces to be treated. Based upon the present inventor's prior experience in this area, the size of the droplets could be as large as about 360 microns with the preferred maximum size being about 260 microns. The amount of the alkanolamine added is a function of the sulfur content of the fuel, and more specifically, the $SO_3$ (sulfur trioxide) produced upon combustion. On an actives basis, as little as about 0.1 pound of alkanolamine per pound of $SO_3$ generated could be used. The preferred minimum is about 0.25 pound of alkanolamine per pound of $SO_3$. Based on economic considerations, the amount of active additive fed could be as high as about 1.0 pound per pound of $SO_3$, while about 0.33 pound of alkanolamine per pound of $SO_3$ represents the preferred maximum.

The temperature of the combustion gases at the time of addition is from about 250° F. to about 675° F., preferably from about 350° F. to about 650° F.

In order to assess the efficacy of the inventive materials various tests were conducted on industrial boiler systems which were fired by fuel oil containing about 2.2 percent sulfur. The abilities of the inventive additive to coat surfaces and to reduce acid deposition, corrosion and fouling were evaluated. Acid deposition rates at various surface temperatures were determined by titrating washings from a standard air-cooled CERL probe. The nature of the surface coating was determined by visual inspection of the probe. The washings were also analyzed for total iron and total solids content to obtain indications of corrosion rates and fouling tendencies, respectively. Using a Land meter, the rate of acid build-up (RBU) was determined.

The material tested was commercially available N-aminoethyl ethanolamine (Naeea) which was obtained from Union Carbide. The additive was mixed with water and a commercially available sodium salt of EDTA (as a stabilizer) to form an aqueous solution comprising 49.9% water, 50% Naeea and 0.1% stabilizer. The additive solution was fed to the combustion gases in a duct at the cold-end of the systems, using an atomizer nozzle located in the duct.

In a first series of tests, which will hereinafter be referred to as the preliminary tests, the combustion gases contained about 18 parts of sulfur trioxide per million parts of combustion gases on a volume basis.

In a second series of tests, which will hereinafter be referred to as the confirming tests, the combustion gases contained about 55 parts of sulfur trioxide per million parts of combustion gases on a volume basis.

EXAMPLE 1

As already noted, the effects of the inventive additive on acid deposition rates at various surface temperatures were determined by titrating washings from a probe similar to a standard British Central Electricity Research Laboratories (CERL) acid deposition probe. The construction and operation of this probe are well known in the art as evidenced by an article entitled "An Air-cooled Probe for Measuring Acid Deposition in Boiler Flue Gases" by P. A. Alexander, R. S. Fielder, P. J. Jackson, and E. Raask, page 31, Volume 38, *Journal of the Institute of Fuel;* which is hereby incorporated by reference to indicate the state of the art. Washings from the probe were titrated for sulfuric acid with sodium hydroxide.

The results of these tests are reported in Table 1A and 1B below in terms of acid deposition rate expressed as milliliters of 0.01N NaOH needed to titrate one fourth of the amount of acid which deposited on 18.8 square inches ($in^2$) to the phenolphthalein end point. The feed-rates reported are expressed as pounds of active additive per hour, and the steam loads reported are also expressed as pounds per hour. The % $O_2$ reported is the oxygen content of the combustion gases on a % volume basis. Table 1A contains the results of the preliminary tests, and Table 1B contains the results of the confirming tests. In the preliminary tests, the acid deposition rates at 220° F. were determined, while in the confirming tests the determinations were for acid deposition at 230° F. and 250° F. In the preliminary tests, the probe was exposed to the combustion gases for 30 minutes; while in the confirming tests, the probe was exposed for the time periods indicated.

TABLE 1A

| Additive | Feedrate (pph) | Steam Load (pph × $10^3$) | % $O_2$ | Acid Deposition 220° F |
|---|---|---|---|---|
| None | — | 50 | 2.75 | 10.5 |
| None | — | 56 | 3.0 | 13.0 |

TABLE 1A-continued

| Additive | Feedrate (pph) | Steam Load (pph × $10^3$) | % $O_2$ | Acid Deposition 220° F |
|---|---|---|---|---|
| None | — | 56 | 2.9 | 14.0 |
| Naeea | 1.2 | 53 | 3.7 | 8.0 |
| Naeea | 3.4 | 50 | 3.8 | 5.5 |
| Naeea | 3.4 | 50 | 3.8 | 4.0 |

TABLE 1B

| Additive | Exposure Time (hrs) | Feedrate (pph) | Steam Load (pph × $10^3$) | % $O_2$ | Acid Deposition 250° F | Acid Deposition 230° F |
|---|---|---|---|---|---|---|
| None | 0.5 | — | 100 | 2.5–3.0 | 28 | 38 |
| None | 0.5 | — | 100 | 2.5–3.0 | 28 | 38 |
| None | 0.5 | — | 114 | 2.5–3.0 | 32 | 46 |
| None | 3.0 | — | 104 | 2.5–3.0 | 72 | 108 |
| Naeea | 0.5 | 2.8 | 100 | 2.5 | 9 | 12 |
| Naeea | 0.5 | 1.2 | 100 | 2.5 | 12 | 20 |
| Naeea | 3.0 | 3.05 | 104 | 2.5–3.0 | 64 | 76 |
| Naeea | 3.0 | 3.1 | 104 | 2.5–3.0 | 32 | 34 |
| Naeea | 0.5 | 4.1 | 114 | 2.5–3.0 | 10 | 10 |

From the results reported in Tables 1A and 1B it can be seen that the rate of acid deposition on the probe was reduced when the N-aminoethyl ethanolamine was added to the combustion gases. This reduction in the acid deposition rate reflects the efficacy of the additive as a neutralizing agent.

EXAMPLE 2

In a second series of tests, the efficacy of the inventive additive with respect to lowering the apparent acid dew point in the cold-end of the boiler systems was evaluated. Using a commerically available Land dew point meter, the condensation of a conducting film of sulfuric acid on a controlled temperature probe tip was detected by the onset of the flow of electric current between electrodes embedded in the tip. This permitted the determination of the apparent acid dew point, and comparative rates of acid build-up directly on probe surfaces were obtainable from the rate of increase in current with time at any tip temperature. The results of these tests are reported in Tables 2A and 2B below. The feed rate of active additive and the boiler steam load are both expressed as pounds per hour, the apparent dew points are expressed as degrees Farenheit (° F.)and the rates of acid build-up (RBU) are expressed as microamperes per minute ($\mu$amp $min^{-1}$). Tables 2A contains the results of the preliminary tests, and Table 2B contains the results of the confirming tests. The rate of acid build-up was determined only for a portion of the tests as indicated in the Tables and was determined at a probe surface temperature of 230° F. for both tests. A reported range for a RBU reading indicates that the RBU changed during the test. The apparent acid dew point is defined as that temperature at which an acid film contacts a surface, at the cold-end in this instance.

TABLE 2A

| Additive | Feedrate (pph) | Steam Load (pph × $10^3$) | % $O_2$ | Dew Point (° F) | RBU |
|---|---|---|---|---|---|
| None | — | 50 | 3.75 | 273 | 110 |
| None | — | 50 | 3.75 | 278 | — |
| None | — | 50 | 3.75 | 277 | — |
| None | — | 53 | 4.1 | 270 | 140 |
| None | — | 53 | 4.1 | 270 | — |
| Naeea | 3.4 | 50 | 3.7 | 122 | 0 |
| Naeea | 3.4 | 50 | 3.7 | 121 | — |
| Naeea | 1.2 | 53 | 4.1 | 265 | 27 |
| Naeea | 1.2 | 53 | 4.1 | 266 | — |
| Naeea | 2.4 | 53 | 3.9 | 195 | 3 |
| Naeea | 2.4 | 53 | 3.9 | 191 | — |

TABLE 2B

| Additive | Feedrate (pph) | Steam Load (pph × $10^3$) | % $O_2$ | Dew Point (° F) | RBU |
|---|---|---|---|---|---|
| None | — | 100 | 2.5–3.0 | 300 | — |
| None | — | 100 | 2.5–3.0 | — | 225 |
| None | — | 100 | 2.5–3.0 | 292 | 225 |
| None | — | 100 | 2.5–3.0 | 304 | 150 |
| None | — | 100 | 2.5–3.0 | 294 | 250 |
| None | — | 104 | 2.5–3.0 | — | 200–300 |
| None | — | 104 | 2.5–3.0 | 295 | — |
| None | — | 104 | 2.5–3.0 | 300 | 200 |
| None | — | 114 | 2.5–3.2 | 293 | 400 |
| None | — | 124 | 2.5–3.0 | 296 | — |
| None | — | 124 | 2.5–3.0 | 300 | — |
| Naeea | 1.3 | 100 | 2.7 | 280 | — |
| Naeea | 3.1 | 101 | 2.5–2.7 | — | 12 |
| Naeea | 4.5 | 104 | 2.5–3.0 | 140 | — |
| Naeea | 3.8 | 104 | 2.5–3.0 | 155 | — |
| Naeea | 3.5 | 104 | 2.5–3.0 | 260 | — |
| Naeea | 3.1 | 104 | 2.5–3.0 | 180 | 8 |
| Naeea | 4.5 | 114 | 2.5–3.0 | 150 | — |
| Naeea | 2.1 | 114 | 2.5–3.0 | 290 | — |
| Naeea | 2.5 | 114 | 2.5–3.0 | 200 | — |
| None | — | 116 | 2.5–3.0 | 300 | 420–560 |
| Naeea | 1.3 | 116 | 2.5–3.0 | 300 | 300–500 |

From Tables 2A and 2B it can be seen that the additive is efficacious both with respect to lowering the apparent acid dew point in the cold-end and with respect to decreasing the rate of acid build-up directly on surfaces in the cold-end. By lowering the apparent acid dew point, the chance of the acid condensing in the cold-end of the boiler system at a given temperature is decreased. Furthermore, by lowering the apparent acid dew point in the cold-end, the combustion gas temperature can be lowered, resulting in an increase in boiler efficiency without a corresponding increase in corrosion of surfaces at the cold-end.

EXAMPLE 3

Using a portion of the washings obtained from the CERL probe described in Example 1, above, the efficacy of the inventive additive with respect to protecting cold-end surfaces against corrosion was evaluated. Since the iron (Fe) content of the washings indicated the amount of corrosion of the test surfaces exposed to the combustion gases, comparisons of the iron content of the washings provided a method of evaluating the efficacy of the inventive material. The results of these comparative tests are reported below in Table 3A and 3B, with Table 3A containing the results of the preliminary tests and Table 3B containing the results of the confirming tests. In the preliminary tests, the probe was exposed to the combustion gases for 0.5 hour, and in the confirming tests the probe was exposed for the periods as indicated in Table 3B. The steam loads and active additive are expressed as pounds per hour (pph), the oxygen content of the combustion gases as percent oxygen (%$O_2$) by volume, and the iron content as parts of iron per million parts of washing liquid at the probe temperatures indicated.

TABLE 3A

| Additive | Feedrate (pph) | Steam Load (pph × $10^3$) | % $O_2$ | Iron (ppm) 230° F | Iron (ppm) 250° F |
|---|---|---|---|---|---|
| None | — | 50 | 3.7 | 3 | 2 |
| Naeea | 3.4 | 50 | 3.8 | 2 | 3 |
| Naeea | 1.2 | 53 | 4.1 | 8 | 6 |

TABLE 3B

| Additive | Exposure (hours) | Feedrate (pph) | Steam Load (pph × $10^3$) | % $O_2$ | Iron (ppm) 230° F | Iron (ppm) 250° F |
|---|---|---|---|---|---|---|
| None | 0.5 | — | 100 | 2.5–3.0 | 70 | 55 |
| None | 0.5 | — | 100 | 2.5 | 60 | 25 |
| None | 3 | — | 104 | 2.5–3.0 | 130 | 70 |
| None | 6 | — | 104 | 2.6–3.1 | 400 | 200 |
| Naeea | 0.5 | 2.8 | 100 | 2.5 | 12 | 10 |
| Naeea | 0.5 | 1.2 | 100 | 2.5 | 55 | 20 |
| Naeea | 3 | 3.05 | 104 | 2.5–3.0 | 40 | 35 |
| Naeea | 3 | 3.1 | 104 | 2.5–3.0 | 10 | 10 |
| Naeea | 6 | 3.1 | 104 | 2.5–3.1 | 25 | 25 |

The results of Table 3A are considered inconclusive, at best. It is the present inventors' opinion that the rather indifferent performance of the additive probably resulted from the low corrosion rates which existed even in the absence of additive.

From the results reported in Table 3B, it can be seen that the corrosion was indeed effectively reduced; and these results are seen to indicate the efficacy of the additive in reducing the corrosion of surfaces exposed to combustion gases in the cold-end of a boiler system.

EXAMPLE 4

In addition to analyzing the washings from the CERL probe for iron content, the total solids content of each sample was also determined to evaluate the fouling tendencies of the subject treatment. While it is expected that an additive treatment at the cold-end of a boiler system will cause some fouling, the additive is considered more effective as its fouling tendencies decrease. The results of these tests are reported below in Tables 4A and 4B. In each of the preliminary tests, the results of which are reported in Table 4A, the probe was exposed to the combustion gases for a period of 0.5 hour; while in each of the confirming tests, the results of which are reported in Table 4B, the probe was exposed for a time period as indicated. The total solids are reported as parts of total solids per million parts of washing water at the probe surface temperatures indicated.

TABLE 4A

| Additive | Feedrate (pph) | Steam Load (pph × $10^3$) | % $O_2$ | Total Solids (ppm) 230° F | Total Solids (ppm) 250° F | Total Solids (ppm) 300° F |
|---|---|---|---|---|---|---|
| None | — | 50 | 3.7 | 100 | 60 | 40 |
| Naeea | 3.4 | 50 | 3.8 | 170 | 80 | 180 |
| Naeea | 1.2 | 53 | 4.1 | 140 | 150 | 80 |

TABLE 4B

| Additive | Exposure Time (hours) | Feedrate (pph) | Steam Load (pph × $10^3$) | % $O_2$ | Total Solids 230° F | Total Solids 250° F | Total Solids 300° F |
|---|---|---|---|---|---|---|---|
| None | 0.5 | — | 100 | 2.5 | 460 | 250 | 75 |
| None | 3 | — | 104 | 2.5–3.0 | 1800 | 1300 | 150 |
| None | 6 | — | 104 | 2.6–3.1 | 3000 | 2000 | 400 |
| Naeea | 0.5 | 2.8 | 100 | 2.5 | 360 | 270 | 180 |

TABLE 4B-continued

| Additive | Exposure Time (hours) | Feedrate (pph) | Steam Load (pph × $10^3$) | % $O_2$ | Total Solids 230° F | 250° F | 300° F |
|---|---|---|---|---|---|---|---|
| Naeea | 0.5 | 1.2 | 100 | 2.5 | 340 | 220 | 80 |
| Naeea | 3 | 3.05 | 104 | 2.5–3.0 | 1200 | 100 | 850 |
| Naeea | 3 | 3.1 | 104 | 2.5–3.0 | 750 | 650 | 450 |
| Naeea | 6 | 3.1 | 104 | 2.5–3.1 | 2600 | 2400 | 1400 |

Based on the results reported above in Tables 4A and 4B, the rate of solids deposition on the surfaces when the additive is used is considered to be exceptional.

EXAMPLE 5

In another series of tests, the CERL probe was exposed to the combustion gases for various periods of time, removed and visually inspected. The results are reported below in Table 5.

TABLE 5

| Additive | Exposure Time (hours) | Appearance of Probe |
|---|---|---|
| None | 0.5 | Green coating on cold-end of Probe. |
| None | 3 | Heavy green coating on cold-end. |
| None | 6 | Very heavy green coating on cold-end, which coating was difficult to wash off. |
| Naeea | 0.5 | Clean, glossy. |
| Naeea eeα | 3 | No apparent build-up. Slightly tacky. Easily washed. |
| Nα | 6 | Shiny. Soot on leading edge. Sticky at cold-end. Easily washed. |

Having thus described the invention, what is claimed is:

1. A method of reducing the amount of sulfur trioxide condensation on, and therefore the amount of sulfuric acid corrosion of, metal parts at the cold-end of a combustion system in contact with combustion gases derived from the combustion of sulfur containing fuel, which combustion gases flow along a path at the cold-end of the combustion system from a first zone of relative turbulence to a second zone at which the turbulence subsides, said method comprising:

adding to the combustion gases at the cold-end of the combustion system and at the zone of turbulence an effective amount for the purpose of an alkanolamine additive comprising N-aminoethyl ethanolamine such that said additive will travel along with said gases, as vapor and/or liquid droplets from said zone of turbulence to said second zone and deposit on surfaces of said metal parts.

2. The method of claim 1, wherein an aqueous solution of the additive is added to the combustion gases.

3. The method of claim 1, wherein the alkanolamine is added in an amount of from about 0.1 to about 1.0 pound per pound of sulfur trioxide produced upon combustion of the fuel.

4. The method of claim 3, wherein the alkanolamine is added in an amount of from about 0.25 to about 0.33 pound per pound of sulfur trioxide produced upon combustion of the fuel.

5. The method of claim 1, wherein the alkanolamine is added in droplet form to the combustion gases.

6. The method of claim 5, wherein the temperature of the combustion gases at the time of addition is from about 250° F. to about 675° F.

7. The method of claim 1, wherein the combustion system is a steam generating system, and wherein the fuel is sulfur-containing oil.

8. The method of claim 7, wherein the alkanolamine is added in droplet form to the combustion gases.

9. The method of claim 8, wherein the temperature of the combustion gases at the time of addition is from about 250° F. to about 675° F.

10. The method of claim 8, wherein an aqueous solution of the additive is added to the combustion gases.

11. The method of claim 1, wherein the temperature of the combustion gases at the time of addition is from about 250° F. to about 675° F.

12. The method of claim 11, wherein the temperature of the combustion gases at the time of addition is from about 350° F. to about 650° F.

13. The method of claim 12, wheein said N-aminoethyl ethanolamine is added in droplet form to the combustion gases.

14. The method of claim 13, wherein an aqueous solution of the additive is added to the combustion gases.

15. The method of claim 13, wherein the droplets have a size of 360 microns or less.

16. The method of claim 15, wherein the droplets have a size of 260 microns or less.

* * * * *